US010500462B2

(12) United States Patent
Francis

(10) Patent No.: US 10,500,462 B2
(45) Date of Patent: Dec. 10, 2019

(54) ADJUSTABLE EASY FIT LACROSSE TRAINING WEIGHT

(71) Applicant: Ripper Products, Inc., Lynbrook, NY (US)

(72) Inventor: Ken Francis, Lynbrook, NY (US)

(73) Assignee: Ripper Products, Inc., Lynbrook, NY (US)

( * ) Notice: Subject to any disclaimer, the term of this patent is extended or adjusted under 35 U.S.C. 154(b) by 0 days.

(21) Appl. No.: 15/838,488

(22) Filed: Dec. 12, 2017

(65) Prior Publication Data

US 2018/0178101 A1 Jun. 28, 2018

Related U.S. Application Data

(60) Provisional application No. 62/439,190, filed on Dec. 27, 2016.

(51) Int. Cl.

| | |
|---|---|
| ***A63B 69/00*** | (2006.01) |
| ***A63B 21/08*** | (2006.01) |
| ***A63B 60/02*** | (2015.01) |
| ***A63B 59/20*** | (2015.01) |
| *A63B 102/14* | (2015.01) |

(52) U.S. Cl.

CPC ..... *A63B 69/00* (2013.01); *A63B 21/08* (2013.01); *A63B 59/20* (2015.10); *A63B 60/02* (2015.10); *A63B 2102/14* (2015.10)

(58) Field of Classification Search

CPC . A63B 69/0026; A63B 60/24; A63B 69/3638; A63B 69/00; A63B 59/50; A63B 69/38; A63B 60/02; A63B 59/20; A63B 21/08; A63B 2102/14

USPC ..... 473/437, 422, 457, 450, 458, 464, 438, 473/446, 560–563, 519, 524–557, 256; D21/729–731, 753, 759

See application file for complete search history.

(56) References Cited

U.S. PATENT DOCUMENTS

| | | | | |
|---|---|---|---|---|
| 2,608,409 A * | 8/1952 | Pinkerton | A63B 69/3638 | 473/437 |
| 3,330,560 A | 7/1967 | Higdon | | |
| 3,507,495 A | 4/1970 | Tucker | | |
| 3,521,883 A * | 7/1970 | Hamilton | A63B 60/00 | 473/437 |
| 3,834,697 A | 9/1974 | McNamara, Jr. et al. | | |
| 4,000,893 A * | 1/1977 | Evans | A63B 69/38 | 473/437 |
| 4,037,841 A * | 7/1977 | Lewis, Jr. | A63B 60/16 | 473/513 |
| 4,052,061 A * | 10/1977 | Stewart | A63B 60/02 | 473/437 |
| 4,206,918 A * | 6/1980 | Lewis, Jr. | A63B 60/48 | 473/513 |
| 4,538,812 A * | 9/1985 | Mugford | A63B 60/02 | 473/437 |

(Continued)

*Primary Examiner* — Mitra Aryanpour
(74) *Attorney, Agent, or Firm* — Hoffmann & Baron, LLP

(57) ABSTRACT

Provided therefore herein is a lacrosse training device, lacrosse training device assembly, and methods of making and using the same. The lacrosse training device includes a weighted assembly of cylindrical sleeves longitudinally oriented with respect to a lacrosse shaft to form a U-shaped collar, a fastening means, and a mounting cap designed to fit on the lacrosse training device; wherein the cylindrical sleeves are designed to accommodate weights.

10 Claims, 3 Drawing Sheets

(56) References Cited

U.S. PATENT DOCUMENTS 4,588,191 A * 5/1986 Stewart ..... A63B 69/3638 473/256
D290,150 S * 6/1987 Stewart ..... D21/759
4,739,994 A * 4/1988 Lewis, Jr. ..... A63B 60/10 473/513
4,890,355 A 1/1990 Schulten
5,127,891 A * 7/1992 Winston ..... A63B 21/065 482/105
5,482,270 A 1/1996 Smith
5,776,006 A * 7/1998 Gruber ..... A63B 69/3638 473/256
5,867,868 A 2/1999 Ward
5,980,397 A * 11/1999 Hart ..... A63B 59/50 473/437
5,993,325 A 11/1999 Heyer
6,328,666 B1 12/2001 Manory
6,500,079 B1 12/2002 Tucker, Sr.
6,533,685 B1 * 3/2003 Otten ..... A63B 59/60 473/437
6,939,273 B2 * 9/2005 Zajac ..... A63B 21/06 473/437
7,048,640 B2 * 5/2006 Light ..... A63B 69/3638 473/226
7,128,667 B2 * 10/2006 Nolan ..... A63B 21/06 473/457
7,588,500 B2 * 9/2009 Hoeckl ..... A63B 69/3638 473/226
7,662,055 B2 2/2010 Cutlip
7,699,723 B2 * 4/2010 Herman ..... A63B 69/00 473/437
8,231,484 B1 * 7/2012 Quinn ..... A63B 69/0002 473/422
8,444,500 B2 5/2013 Erkkinen
8,500,609 B1 8/2013 Williams
D703,283 S * 4/2014 Livingston ..... D21/753
2002/0128085 A1 9/2002 Kallassy
2004/0176194 A1 9/2004 Mitchell
2004/0259666 A1 12/2004 Bjugstad et al.
2005/0130759 A1 6/2005 Hayden et al.
2005/0130773 A1 6/2005 Hayden et al.
2005/0261075 A1 11/2005 Pullaro
2005/0277491 A1 * 12/2005 Nolan ..... A63B 21/06 473/451
2006/0154755 A1 7/2006 Velasquez
2010/0137078 A1 * 6/2010 Liberatore ..... A63B 15/00 473/437
2012/0302380 A1 * 11/2012 Erkkinen ..... A63B 69/3638 473/437

* cited by examiner

ADJUSTABLE EASY FIT LACROSSE TRAINING WEIGHT

CROSS-REFERENCE TO RELATED APPLICATIONS

This present application claims priority from U.S. Provisional Application No. 62/439,190, filed Dec. 27, 2016, herein incorporated by reference in its entirety.

BACKGROUND OF INVENTION

The present invention relates generally to lacrosse equipment, and more particularly, to a lacrosse training aid, as well as methods of manufacture and use.

Conventional lacrosse sticks include a basket, or head, joined to a handle, or shaft. The head includes a frame that forms a region within which a lacrosse ball can be caught, held or from which the ball is shot. A netting structure is joined with the back side of the frame, typically laced through multiple small holes defined by the frame. The netting structure typically forms a pocket within which the ball is held while a player is in possession of the ball, and can be a determinant factor as to the player's ability to catch, retain and shoot the ball.

Lacrosse is an ancient game that originated with the Native Americans in North America, particularly in the northeastern United States and Canada. Traditionally, lacrosse sticks were made of wood, usually hickory or ash, and were one integrated piece of equipment so the shaft was not a separate and replaceable part. These sticks were handcrafted and varied in quality in terms of strength, weight, feel and balance in the player's hands. These wooden handles were susceptible to breakage, were heavy and had inconsistent quality, which proved disadvantageous from both a playability and safety standpoint. Also, because the shafts and the lacrosse stick head were one integrated piece of equipment; if the shaft broke the entire stick had to be replaced.

In 1967, the molded plastic lacrosse sticks head, as described in U.S. Pat. No. 3,507,495, was developed, which greatly revolutionized the sport of lacrosse. The invention allowed lacrosse sticks to be mass produced, as well as manufactured with consistency in terms of quality and consistency in shape. Wood shafts continued to be used, although they were still susceptible to breakage and were too heavy as compared to the new non-wood sticks.

In the 1970s, shafts of metallic construction, as described in U.S. Pat. No. 4,037,841, were developed. These metal shafts, in large measure, replaced the wood lacrosse stick handles, particularly in the men's game. The advantage of such construction was that the metal shafts could be mass produced with uniform quality, strength and weight, and were generally stronger than wood shafts.

Today, lacrosse stick shafts are made from a variety of materials such as aluminum, chrome, aluminum alloy, titanium, Kevlar, scandium, magnesium, and other composite materials, such as graphite loaded plastics, which are described in U.S. Pat. No. 4,739,994, and are lighter and in some cases, stronger, than wood or the first metal shafts. Historically, most improvements to lacrosse stick shafts were directed to the use of new and different materials with minor additional modifications such as knurling or the like as described in U.S. Pat. No. 4,206,918. All handles were very basic in their shape, generally octagonal, elliptical, oval, cylindrical, round or hexagonal or a combination thereof in cross-section and all were straight from end to end.

In lacrosse, the ability to grasp the shaft in a manner and with an ability to handle the ball is critical. It is needed to perform essential activities, such as cradling, scooping, throwing, or shooting the ball. In particular, when cradling the ball, a player needs to grip the shaft such that the outer ends of their fingers are able to roll the shaft into the palm of one's hand. Such a motion is not intuitive, and utilizes muscles not typically relied on in other activities or sports. As such, it is a difficult task to perform by a user, and difficult to teach for a coach. It is also a skill which requires a lot of practice to master.

In sports such as baseball, it is known that weights in the form of rigid rings may be added to the bat to improve strength, act as a stretching routine, and improve agility. These rings are secured by the increasing dimension of a standard bat. Lacrosse sticks, however, typically utilize fairly uniform width sticks. Therefore the ability to add weight to a lacrosse stick requires a more complex solution. In order to add weight to a lacrosse stick, it must be adequately secured to avoid slippage or disconnect. Additionally, the motion of use of a lacrosse stick during use practice involves a plurality of angles and speeds which are not present when using a bat. Therefore, any added weight must be suitably secured to stay on the shaft during such motions.

Further, it is also desirable for such added weight to be positioned in close proximity to optimize effect. The added momentum can be highly beneficial to a player's development. Since it is desirable for such a weight to be added to a player's existing stick, it is necessary that any such weight be easily installed and removed. Additionally, it would also be beneficial to have a training weight which could grow with the user. As a player gets older and more mature, it would be useful to have a training weight which was adaptable so that more weight could be added thereto.

It would therefore be highly desirable to have a weighted stick practice aid that was simply and securely attachable to a wide variety of lacrosse stick assemblies. It would further be highly desirable to have such a weighted stick practice aid that added weight to the lacrosse stick assembly in close proximity to the lacrosse head. Finally, it would be highly desirable for such a weighted aid to be simply and easily removable prior to use of the lacrosse stick assembly in play. This would allow an athlete to utilize the weight assembly to warm up and stretch prior to entering official play.

Much of the attention in improving lacrosse sticks, has focused on improving its grip. U.S. Pat. No. 6,500,079 to Tucker, Sr., for example, teaches a variable hand placement sports equipment shaft or handle, such as a lacrosse stick, that includes a shaft and at least one overlay attached to the shaft at a location of frequent hand placement that contains ribs, grooves, hourglass and conical shapes. The overlays are preferably made of a material that is soft, pliable, deformable and tacky so as to provide the player with a better grip on the handle. Similar overlays are disclosed in U.S. Pat. No. 4,890,355 to Schulten, U.S. Pat. No. 5,482,270 to Smith, and U.S. Pat. No. 5,867,868 to Ward.

Furthermore, other modifications to shafts for improved handling are available in the prior art. For example, U.S. Patent Application Publications 2005/0130759 and 2005/0130773, both to Hayden et al., teach lacrosse sticks with an improved grip and feel due to expanded portions and contoured locations for users' hand(s). An inward tapered portion and expanded portion allegedly assist a player in controlling the shaft, cradling a ball, passing and shooting.

The majority of training weights are general purpose devices such as ankle weights, weight vests, wrist weights, and weight belts that attach to the athlete's body. Another general category is weighted devices that mimic the shape and size of sports equipment. Two such devices are outlined in United States Patent Applications 20040176194 (Lacrosse training device) and 20050261075 (Sports training and conditioning device). The other general category includes training weights which attach to sports equipment and are targeted at specific sports such as baseball, tennis, golf, hockey, and lacrosse. The majority of these devices are intended to be attached to the handle or shaft of the sports equipment. Examples are outlined in United States Patent Applications 20050277491 (Adjustable weight training belt for a baseball bat), 20040259666 (Weighted training tape), 20020128085 (Swing weight) and U.S. Pat. No. 5,993,325 (Flexible swing weight). The category of the present invention is those devices that attach to the head of the sports equipment. One such device for tennis rackets is outlined in U.S. Pat. No. 3,330,560, issued Jul. 11, 1967.

Two weight training products are currently found marketed in the general merchandise catalogs for lacrosse. The first product is a weighted lacrosse handle marketed by Warrior, the Powermaster Training Handle and is not in the category of the present invention. The second product is the Warrior Weighted Stick Doughnut. This second product attaches at the bottom of the lacrosse head and around the top of the lacrosse handle, concentrating the entire weight locally. A disadvantage of the second product and other prior art weighted training devices is the use of fabric as the outer casing to hold the weight medium. Fabric is flexible and allows these prior art training weights to wrap around sports equipment and an athlete's body parts. However, fabric has no structural rigidity. This lack of structural rigidity allows undue relative motions of the prior art devices during use. With a fabric casing, both shifting of the weight device relative to the sports equipment and shifting of the weight medium relative to the fabric casing occur. These undesirable relative motions are exaggerated by the back and forth rotational cradling motion required in lacrosse.

Despite the attempts to improve lacrosse training devices, and the attempt to utilize weighted training in such devices, there remains a strong need for an improved lacrosse stick weighting device which is easy to install, and whose weight is adjustable to accommodate players of different strength.

SUMMARY OF THE INVENTION

Provided therefore herein is a lacrosse training device. The lacrosse training device includes i) a weighted assembly of cylindrical sleeves longitudinally oriented with respect to a lacrosse shaft to form a U-shaped collar, ii) a fastening means comprising a clasping means, the clasping means connecting to an opposing mated clasping means on the U-shaped collar, the fastening means securing the lacrosse training device to a lacrosse shaft, the fastening means further comprising at least one cylindrical sleeve which is oriented in parallel fashion to the cylindrical sleeves of the U-shaped collar, and iii) a mounting cap designed to fit on the lacrosse training device; wherein the cylindrical sleeves are designed to accommodate weights.

In an embodiment, the clasping means of the fastening means of the lacrosse training device are a press-fit connection wherein a cylindrical sleeve of the U-shaped collar is pressed into a c-shaped open-faced half cylindrical sleeve of the fastening means. In another embodiment, the weights are cylinders fitted for insertion into the cylindrical sleeves. In an embodiment, the mounting cap comprises a first U-shaped collar cap and a second fastening means cap. In an embodiment the mounting cap provides a cover for the cylindrical sleeves to maintain said weights therein.

In an embodiment, the U-shaped collar comprises at least one cylindrical sleeve. In another embodiment, the U-shaped collar comprises at least two cylindrical sleeves. In yet another embodiment, the U-shaped collar comprises seven cylindrical sleeves. In an embodiment, the U-Shaped collar and fastening means together comprise an inner octagon-shaped channel mated to an octagon-shaped lacrosse shaft. In an embodiment, the inner octagon-shaped channel further includes a liner for securely fastening the training device to the lacrosse shaft. In an embodiment, the liner is a foam protective layer which helps secure the lacrosse training device in place on the lacrosse shaft.

In yet another embodiment the present invention includes a lacrosse training device assembly. The lacrosse training device assembly includes a lacrosse stick and a lacrosse training device. The lacrosse training device comprising: i) a weighted assembly of cylindrical sleeves longitudinally oriented with respect to a lacrosse shaft to form a U-shaped collar; ii) a fastening means comprising a clasping means, the clasping means connecting to an opposing mated clasping means on the U-shaped collar, the fastening means securing the lacrosse training device to a lacrosse shaft, the fastening means further comprising at least one cylindrical sleeve which is oriented in parallel fashion to the cylindrical sleeves of said U-shaped collar; and iii) a mounting cap designed to fit on the lacrosse training device; wherein the cylindrical sleeves are designed to accommodate weights.

In yet another embodiment, the present invention includes a method of making a lacrosse training device comprising forming a U-shaped collar comprising a weighted assembly of cylindrical sleeves longitudinally oriented with respect to a lacrosse shaft, forming a fastening means comprising a clasping means, said clasping means designed to be connected to an opposing mated clasping means on said U-shaped collar, said fastening means securing said lacrosse training device to a lacrosse shaft, said fastening means further comprising at least one cylindrical sleeve which is oriented in parallel fashion to said cylindrical sleeves of the U-shaped collar. In another embodiment the method of making a lacrosse training device further includes forming a mounting cap designed to fit on the lacrosse training device.

In yet another embodiment, the present invention includes a method of using a lacrosse training device. The method includes appending a lacrosse training device to a lacrosse stick. The lacrosse training device includes a U-shaped collar comprising a weighted assembly of cylindrical sleeves longitudinally oriented with respect to a lacrosse shaft, appending the U-shaped collar to a shaft of the lacrosse stick with a fastening means, the fastening means including a clasping means, the clasping means designed to be connected to an opposing mated clasping means on the U-shaped collar, the fastening means further comprising at least one cylindrical sleeve which is oriented in parallel fashion to said cylindrical sleeves of the U-shaped collar.

For a better understanding of the present invention, together with other and further objects and advantages, reference is made to the following detailed description, taken in conjunction with the accompanying examples, and the scope of the invention will be pointed out in the appended claims. The following detailed description is not intended to restrict the scope of the invention by the advantages wet forth above.

DETAILED DESCRIPTION OF THE INVENTION

The training device of the present invention is a weighted device designed to increase shot speed, cradle quickness, and strength. Its ease of use and adjustability provide a user with a training device not heretofore available. The training device is easily placed on the shaft of a lacrosse stick and secured with a door and clasp. The training device may contain weights 8 that can be added or subtracted depending on the size of the user and the amount of weight desired for the workout. It can be used by a young player and grow with them as they mature and get stronger, simply by adding more weights to the device.

Figure 1:
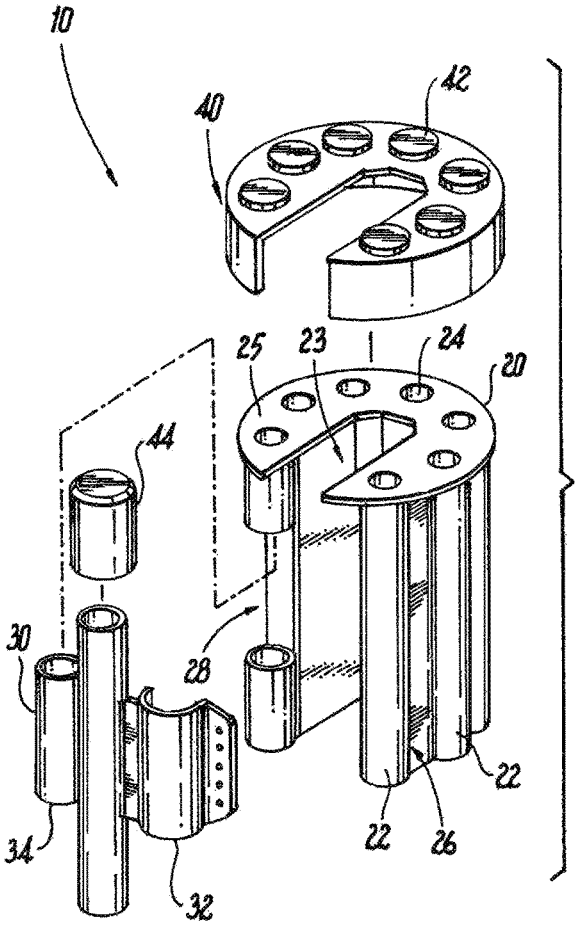
FIG. 1 is an exploded view of the lacrosse training device of the present invention.
Figure 2:
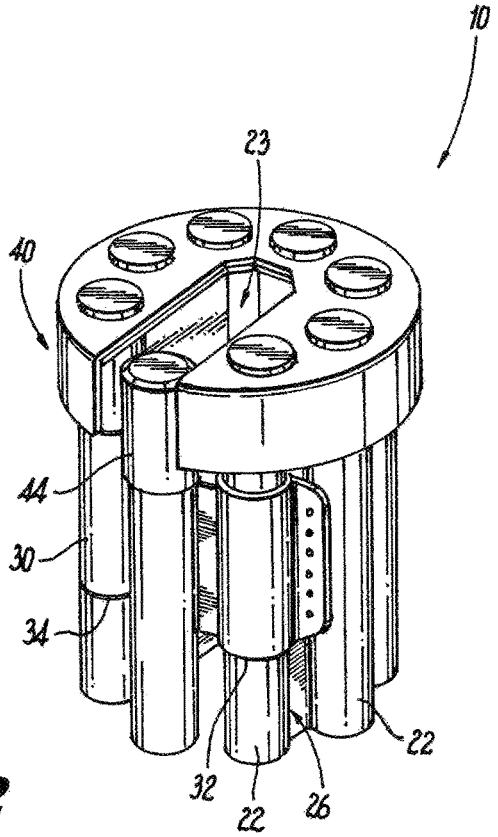
FIG. 2 is a view of an assembled lacrosse training device of the present invention.

With reference to the drawings, FIG. 1 shows a lacrosse training device 10 including a U-shaped collar 20 and a fastening means 30. The lacrosse training device further includes a cap 40, which includes two parts, a U-shaped collar cap 42, and a fastening means cap 44.

U-shaped collar 20 includes an assembly of cylindrical sleeves 22 longitudinally oriented such that they are parallel, or nearly parallel with a lacrosse shaft to which it is appended, or attached. Cylindrical sleeves 22 include an open end 24 and a closed end 26. The open end 24 is where cylindrical weights 8 may be inserted. Fastening means cap 42 serves as a barrier to keep cylindrical weights 8 within sleeves 22. Fastening means 30 includes clasping means 32 which may be any clasping means which can connect the two pieces together around a lacrosse shaft, but is shown here a C-shaped half-cylinder open faced, and designed to receive a cylindrical sleeve 22 therein. The C-shaped piece 32 securely fits around cylindrical sleeve 22, such that it biases slightly during the connection process, but rebounds to securely fasten on sleeve 22. Fastening means 30 also may have a cylindrical sleeve 34, whose length is less than that of the standard cylindrical sleeve 22, and is on the side opposed clasping means 32, cylindrical sleeve fitting into a cut-our portion 28 of a cylindrical sleeve 22 to form a contiguous sleeve once assembled. When cylindrical sleeve 34 is fitted into cut-out portion 28, and a weight is inserted therein, it serves as a second means of attachment of fastening means 30 to U-shaped collar 20 since the weight would hold the otherwise unconnected U-shaped collar 20 and fastening means 30 together. In an embodiment, a second clasping means may fit where cylindrical sleeve 34 is shown in FIG. 1.

Figure 3:
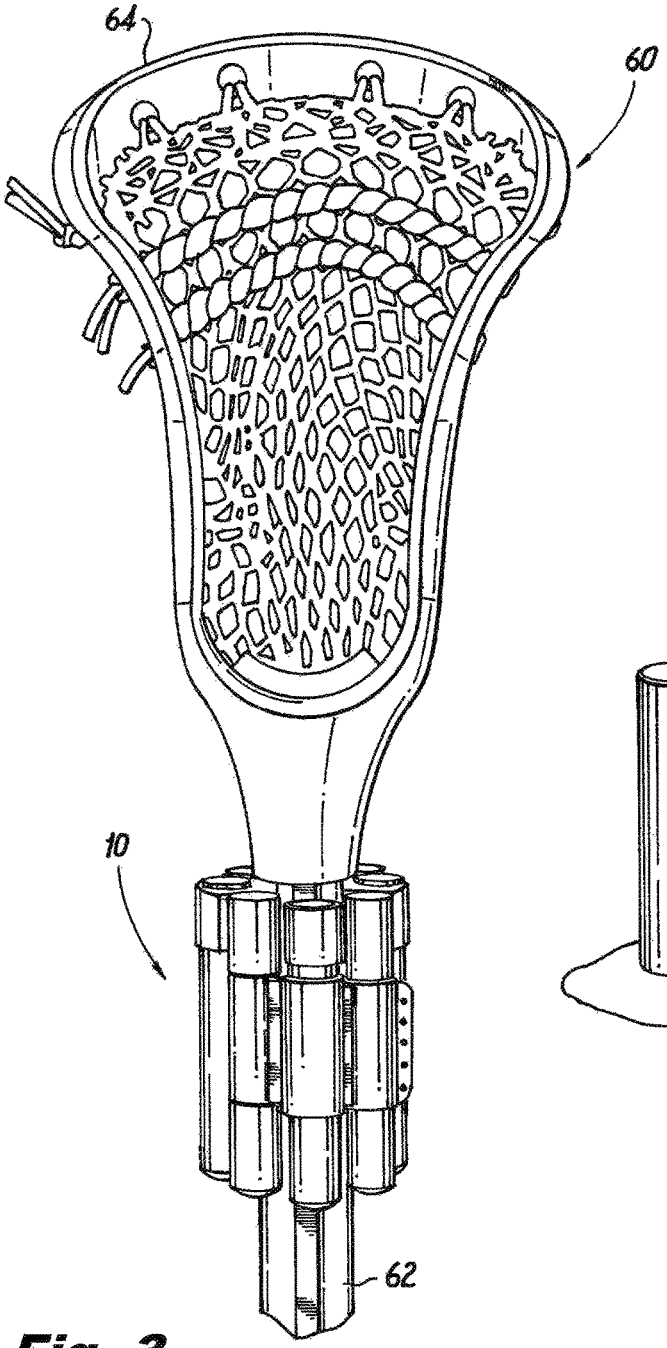
FIG. 3 is a view of the lacrosse training device appended to a lacrosse stick.
Figure 4:
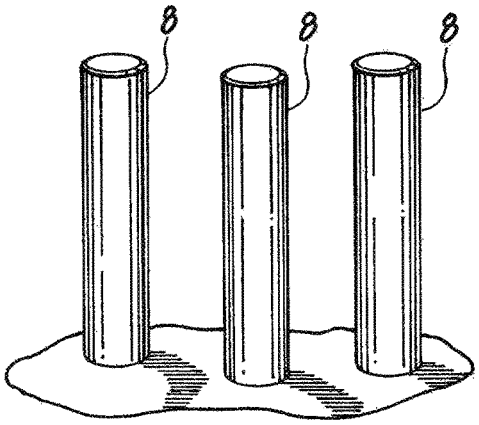
FIG. 4 shows cylindrical weights which may be inserted into the lacrosse training device.

With reference now to FIG. 3, a lacrosse stick 60 is shown with lacrosse training device 10 attached thereto. U-shaped collar 20 fits on a lacrosse stick by inserting a lacrosse stick through U-shaped cross-section 23, which is mated to fit snugly on a lacrosse stick, as shown in FIG. 3. U-shaped cross-section 23 may, in conjunction with fastening means 30 have an inner channel mated to a lacrosse stick; e.g., it may have an octagonal cross-section to match the octagonal cross-section of the lacrosse stick cross-section.

Figure 5:
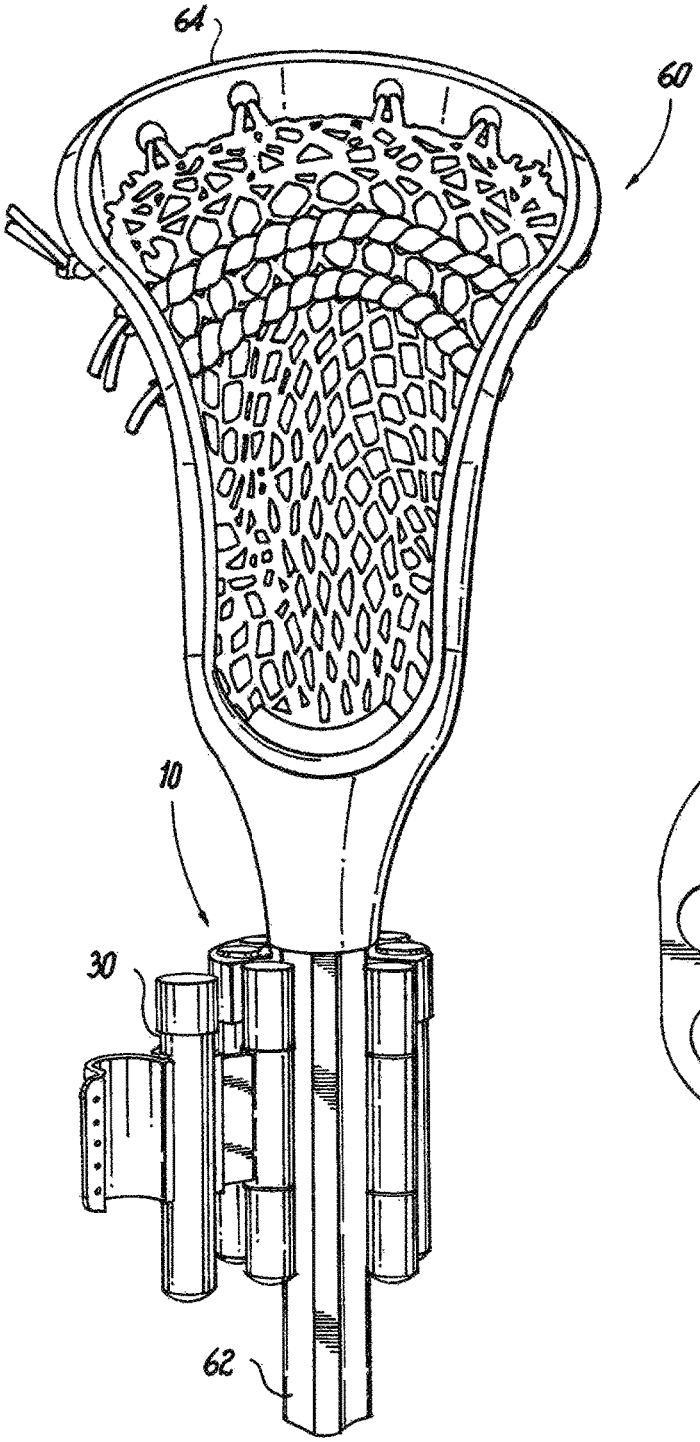
FIG. 5 is a view of a nearly assembled lacrosse training device of the present invention.

With reference now to FIG. 5 of the drawings, lacrosse stick 60 has a lacrosse training device 10 attached thereto. Fastening means 30 is attached to a shaft 62 of lacrosse stick 60, such that cylindrical sleeve 34 is fitted into cut-out portion 28 of the U-shaped collar. Cylindrical weight 8 is inserted therein, and the assembly thus serves as a hinge upon which fastening means 30 can open and shut like a door to secure device 10 to stick 60.

Figure 6:
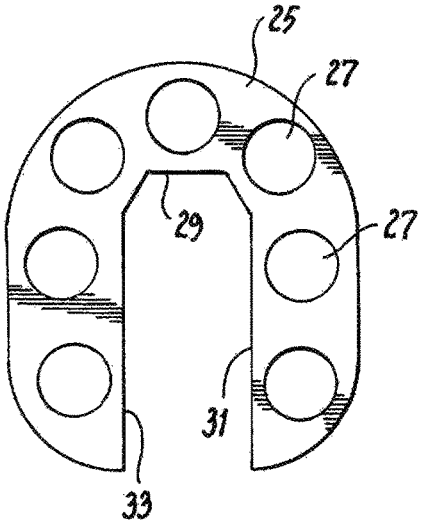
FIG. 6 is another view of the U-shaped collar of the lacrosse training device of the present invention.

U-shaped collar 20 also has a top face 25, which when assembled on the lacrosse stick 60, is the end which is closer to the head, or basket 64 of lacrosse stick 60. With reference to FIG. 6 of the drawings, top face 25 is shown from a different perspective, so that only top face 25 can be seen. Openings 27 of cylindrical sleeves 22 are shown as holes through which cylindrical weights 8 may be inserted. A U-shape of U-shaped collar 20 can clearly be seen with bottom wall 29 shown, positioned relative to sidewalls 31 and 33 to form a U-shape.

The weights are easily accessible by twisting the mounting cap, which may be a bayonet clip top to reveal the 8 weighted slots. The training device is designed for practice. It is a great instrument for "wall ball" or to have a catch with a partner. It is also designed so that the user can practice their cradling to increase quickness.

In an embodiment, the training device can weigh approximately 32 ounces when all the weights are inserted, including the actual weight of the training device. Each weight can be approximately 3 ounces. One of the weights may be used as a hinge for the door and must stay inserted at all times. When there is a weight in the door that can't be removed, the device is approximately 14 ounces to start. The training device may be made from hard durable plastics that will be able to withstand a drop or incidental hit. The weights may be made of cast iron.

The training device is designed to be used with the door facing the potential target, whether that be a wall or person. The door closes with a "snap" like clip that closes with the door containing an extension or male piece of plastic and closes or snaps into a female slot that secures it shut. The top clip or bayonet clip, twist open and shut to secure the weights so they won't shift or pop out at any time. The inside of the training device may contain a thin rubber like sleeve that will help protect the shaft of the lacrosse stick and to prevent slippage of any kind. The flexibility with accessing the weights and the easiness of getting the training device on and off the lacrosse stick is one of its biggest attributes. The training device is designed to grow with the lacrosse player throughout their careers.

Thus while there have been described what are presently believed to be preferred embodiments of the invention, those skilled in the art will realize that changes and modifications may be made thereto without departing from the spirit of the invention, and it is intended to claim all such changes and modifications as fall within the true scope of the invention.

I claim:

1. A lacrosse training device comprising:

i) a weighted assembly of cylindrical sleeves longitudinally oriented with respect to a lacrosse shaft to form a U-shaped collar;

ii) a fastening means comprising a clasping means, said clasping means connecting to an opposing mated clasping means on said U-shaped collar, said fastening means securing said lacrosse training device to a lacrosse shaft, said fastening means further comprising at least one cylindrical sleeve which is oriented in parallel fashion to said cylindrical sleeves of said U-shaped collar, said clasping means comprising a press-fit connection wherein a cylindrical sleeve of said U-shaped collar is pressed into a c-shaped open-faced half cylindrical sleeve of said fastening means;

iii) a mounting cap designed to fit on said lacrosse training device; wherein said cylindrical sleeves are designed to accommodate weights, and said weights are secured in said cylindrical sleeves by said mounting cap.

2. The lacrosse training device of claim 1 further comprising cylindrical weights fitted for insertion in said sleeves.

3. The lacrosse training device of claim 2 wherein said weights are cylinders fitted for insertion into said cylindrical sleeves.

4. The lacrosse training device of claim 1 wherein said mounting cap comprises a first U-shaped collar cap and a second fastening means cap.

5. The lacrosse training device of claim 3 wherein said mounting cap provides a cover for said cylindrical sleeves to maintain said weights therein.

6. The lacrosse training device of claim 1 wherein said U-shaped collar comprises at least one cylindrical sleeve.

7. The lacrosse training device of claim 1 wherein said U-shaped collar comprises at least two cylindrical sleeves.

8. The lacrosse training device of claim 1 wherein said U-shaped collar comprises seven cylindrical sleeves.

9. The lacrosse training device of claim 1 wherein said U-Shaped collar and fastening means together further comprise an inner octagon-shaped channel mated to an octagon-shaped lacrosse shaft.

10. A lacrosse training device assembly including a lacrosse stick and a lacrosse training device, said lacrosse training device comprising:

i) a weighted assembly of cylindrical sleeves longitudinally oriented with respect to a lacrosse shaft to form a U-shaped collar;

ii) a fastening means comprising a clasping means, said clasping means connecting to an opposing mated clasping means on said U-shaped collar, said fastening means securing said lacrosse training device to a lacrosse shaft, said fastening means further comprising at least one cylindrical sleeve which is oriented in parallel fashion to said cylindrical sleeves of said U-shaped collar, said clasping means comprising a press-fit connection wherein a cylindrical sleeve of said U-shaped collar is pressed into a c-shaped open-faced half cylindrical sleeve of said fastening means;

iii) a mounting cap designed to fit on said lacrosse training device; wherein said cylindrical sleeves are designed to accommodate weights.

* * * * *